United States Patent [19]

Dow et al.

[11] Patent Number: 4,848,233

[45] Date of Patent: Jul. 18, 1989

[54] MEANS FOR PROTECTING ELECTROEXPLOSIVE DEVICES WHICH ARE SUBJECT TO A WIDE VARIETY OF RADIO FREQUENCY

[75] Inventors: Robert L. Dow, LaPlata; Paul W. Proctor, White Plains, both of Md.

[73] Assignee: The United States of America as represented by the Secretary of the Navy, Washington, D.C.

[21] Appl. No.: 782,325

[22] Filed: Oct. 1, 1985

[51] Int. Cl.[4] ..... F42B 3/18; F42C 19/12

[52] U.S. Cl. ..... 102/202.2

[58] Field of Search ..... 102/202.2, 202.1, 202.5, 102/472; 336/232

[56] References Cited

U.S. PATENT DOCUMENTS

| | | | |
|---|---|---|---|
| 2,821,139 | 1/1958 | Apstein et al. | 102/70.2 |
| 2,918,001 | 12/1959 | Alford | 102/28 |
| 2,991,715 | 7/1961 | Slough | 102/28 |
| 3,180,262 | 4/1965 | Talley et al. | 102/28 |
| 3,762,331 | 10/1973 | Vlahos | 102/70.2 R |
| 4,304,184 | 12/1981 | Jones | 102/202.13 |
| 4,378,738 | 4/1983 | Proctor et al. | 102/202.7 |

FOREIGN PATENT DOCUMENTS

| | | | |
|---|---|---|---|
| 3502526 | 8/1985 | Fed. Rep. of Germany | 102/202.2 |

*Primary Examiner*—Charles T. Jordan

*Attorney, Agent, or Firm*—Frederick A. Wein; John D. Lewis

[57] ABSTRACT

An RF attenuator for attenuating RF signals in a lead particularly for protecting against unintentional detonation of electrically initiated ammunition is presented. A firing lead is embedded in a body of ferrite material. The firing lead is formed in a planar spiral configuration with reversals of direction.

5 Claims, 2 Drawing Sheets

MEANS FOR PROTECTING ELECTROEXPLOSIVE DEVICES WHICH ARE SUBJECT TO A WIDE VARIETY OF RADIO FREQUENCY

BACKGROUND OF THE INVENTION

1. Technical Field

The present invention relates generally to electrically fired explosive devices, and more particularly to control elements for protecting small electrically fired, fixed case ammunition from the hazards of unintended firing due to stray radio frequency energy.

2. Background Art

Electroexplosive devices such as electric blasting caps, squibs and detonators are used in many contexts, such as blasting operations, ammunition and the like. Electroexplosive devices include at least one electrical ignition device disposed in ignition relationship with one or more heat-sensitive explosive charges, such as first fire mixtures, and are fired by passing a D C current through a pair of leads connected to a filament or bridge of high electrical resistance which is in heat transferring contact with the first fire mixture. A sufficient flow of current heats the bridge wire to indescance thereby igniting the surrounding mixture. The energy generated from ignition of the mixture is then used to ignite a sequence of pyrotechnic and/or explosive charges which in turn can ignite or detonate other charges.

These electroexplosive devices are subject to unintended discharge by stray electromagnetic or electrostatic energy. Therefore, electric firing techniques have included procedures intended to minimize this possibility and to protect individuals in the vicinity of these devices. However, the value of such precautionary measures is diminished because it is difficult to predict the extent of the electromagnetic radiation hazard from one moment to the next and the levels of electrical hazards are steadily increasing.

Prior attempts at solving the problems associated with electroexplosive devices caused by stray radio frequency energy have included decreasing the sensitivity of the bridge by designing the bridge to require very high firing currents for igniting the pyrotechnic chemical disposed adjacent to that bridge. This approach requires the use of heavy and expensive wiring and requires the use of power sources providing high energy levels. In addition to the increased expense associated with this approach, this approach still fails to provide adequate safety.

In the past, most electroexplosive devices that are suitable for use in radiation hazards environments have used a filter and heat sink combination. The filter attenuates the radiation and the heat sink transfers heat generated during attenuation away from the bridge wire and explosive components. One such filter is disclosed in U.S. Pat. No. 4,378,738 of Proctor et al. of a common assignee. However, the '738 devices are too large to be compatible with fixed or semi-fixed ammunition and therefore extensive modifications would have to be made in order to adapt these devices to a small size. Such modifications are unacceptable for many reasons, including a concomitant requirement to alter various procedures associated with the manufacture of such devices and perhaps a requirement to alter existing firing circuits. Furthermore, to be effective, the filter must be coupled closely to the bridge wire leads and shielded from electromagnetic radiation leakage paths.

Furthermore, in fixed case or semifixed ammunition unit cost is extremely important. Under many conditions, the heat sink associated with the presently known devices may not be large enough. However, adding external heat sinks may be impractical due to size, cost and use considerations. Furthermore, since the explosive output of the device is usually buried in a booster or explosive, there may be no available area for an additional heat sink.

Due to these problems, it has been proposed to use ferrite beads to attenuate radio frequency energy. However, such approaches require use of capacitors in order to obtain broadband attenuation and even then the low frequency attenuation may be unacceptable. In such a case it was necessary to use a plurality of ferrite beads in series along each of the two electrical leads with capacitors connected between junctions of corresponding beads of the two leads thus forming a low-pass attenuation network. Still further attenuation problems arise because the ferrite used in these devices had low curie temperatures so that attenuation of even moderate radiation caused sufficiently high temperatures to vitiate the attenuation properties of the device. The use of capacitors, itself creates problems because the combined device and capacitor is too bulky to fit a small primer pocket. Even then, it is questionable whether a single capacitor will provide the device with the capability to cover a frequency spectrum of from about one megahertz to about eleven gigahertz as is required to include the known hazards.

Accordingly, there is a need for a device which is effective in protecting small devices against the hazards associated with stray electromagnetic energy in a cost-effective manner.

SUMMARY OF THE INVENTION

It is an object of the present invention to protect electrically fired, fixed case ammunition from stray radio frequency energy.

It is another object of the present invention to protect small electrically fired, fixed case ammunition from stray radio frequency energy without requiring modification of existing electrically fired device firing circuits, designs or procedures. In this manner, existing equipment can be protected without undue expense or problems.

It is still another object of the present invention to protect small electrically fired, fixed case ammunition from stray radio frequency energy without requiring additional capacitors and/or heat sinks.

A further object of the present invention to permit use of simple, light weight gun and gun pod design to be used with electrically fired primers.

These and additional objects are accomplished when an RF attenuating ferrite material similar to standard ferrite formulation MN-67 or the like is used as an attenuating body and a firing lead made of a conductive material in a portion of the body forms a planar, spiral configuration in the ferrite body. The maximum thickness dimension of the device can be small as compared to its maximum planar dimension and a plurality of loops of the firing lead can be defined.

In order to fully protect small, fixed case electrically fired ammunition, attenuation of stray radio frequencies must be accomplished, and in addition, an electrostatic shunt mechanism should be used in connection with electrostatic buildup protection. It has been found that a choke can be used to attenuate RF energy. However, the energy level to be attenuated by a choke effects the size of that choke, and in order to provide adequate protection, especially if the protection is to be broadband, size becomes a factor which is an important consideration for small, fixed case electroexplosive devices, such as a fixed or semi-fixed case firing primer. Therefore, cylindrical chokes such as disclosed in U.S. Pat. No. 4,378,738, are too large for such applications. It has also been found that lossy material such as MN-67 has reasonable attenuation at broadcast frequencies. The MN-67 ferrite has a high curie (450° F.) temperature, a good trade-off of low frequency attenuation and broadband attenuation without detected resonant frequencies and is available in many shapes and sizes. Since higher RF attenuation is achieved when a conductive path through a ferrite body is lengthened, a tradeoff between the length of conductor required to produce the desired attenuation band protection and the size requirements dictated by small ammunition size, cost and heat transfer characteristics is made. Therefore, merely combining the MN-67 with a cylindrical choke as in the '738 patent will produce a device which is still too large for use in small primer devices.

It was discovered as disclosed herein that a single firing lead can be wound in a spiral pattern located in a single plane and still produce capacitance effects similar to the capacitance achieved with cylindrical chokes also without detected resonance frequencies. Therefore, instead of making a device having cylindrical form having a high length to diameter ratio superior attenuation can be achieved in a much smaller device by placing a firing lead in the body material in a planar, spiral pattern. The number of spiral loops is adjusted to produce the maximum length of lead (for maximum RF attenuation) possible for the size of the device which is permitted by small fixed case ammunition. Specifically, it has been found in an alternate embodiment that by winding the lead through the ferrite core a number of times with two or more reversals of direction, the highest attenuation is achieved for the space available. Such a winding pattern permits the device to have an outside diameter selected so that when the device can be pushed into the primer pocket during manufacture with a fit snug enough to produce enough heat transfer to the case to inhibit the problems associated with heating of the ferrite material during attenuation without requiring an external heat sink. Furthermore, the device can be manufactured to be compatible with existing machinery, firing circuit design and procedures thereby overcoming many cost related problems, and external capacitors are not required, thereby contributing to the cost effectiveness of the device. It has also been found that because the exemplary MN-67 material is electrically nonconductive for all practical purposes, the need for electrically insulating washers is eliminated thereby contributing still further cost-saving advantages to the present invention. For purposes of this disclosure the body being nonconductive means much less electrically conductive than the firing lead.

DETAILED DESCRIPTION OF THE DRAWINGS

A more complete understanding of the invention and a fuller appreciation of the many attendant advantages, features and still other objects thereof may be readily derived by reference to the following detailed description when considered in connection with the accompanying drawings, wherein.

DETAILED DESCRIPTION OF THE PREFERRED EMBODIMENT

Figure 1:
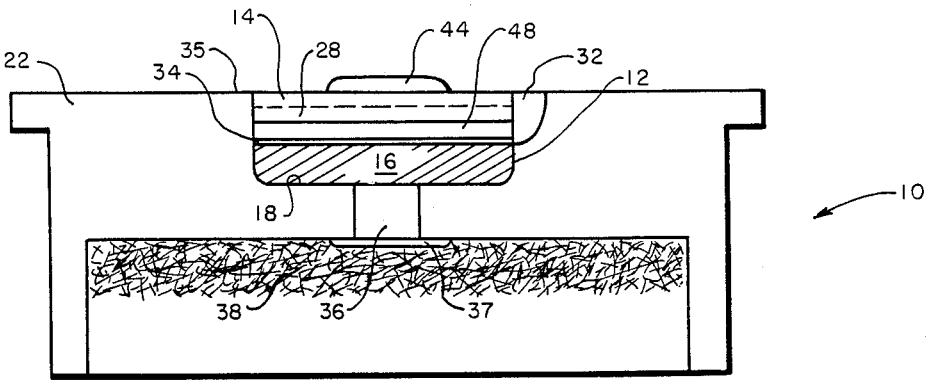
FIG. 1 is a cross-sectional view of a fixed case ammunition case having an electroexplosive device embodying the protective attenuator of the present invention.

As a background, FIG. 1 shows the after end of a typical fixed case ammunition shell generally designated 10 having a primer pocket 12 housing a protective device or attenuation element 14 A conventional electrically fixed primer 16 is pressed in as usual against bottom 18 of the primer pocket 12. The primer pocket 12 is placed in aft end of an exemplary g ammunition case 22. An attenuator element 14 is pressed in place into case 22 so that:

a. An input button 44 is sufficiently exposed so that it can come into contact with the electric firing means (not shown) associated with the case 22.

b. Body 28 of element 14 is pressed into contact with the metal of case 22 to dissipate the heat generated when the ferrite material of element 14 attenuates stray RF energy.

c. Output from an output button 32 is in contact with electrostatic dissipating tape 34 so that any excessive electrostatic potential between primer and ammunition case is bled off before it can inadvertently set off the primer.

d. The electrostatic dissipation tape 34 is pressed tightly enough so that D.C. current can pass freely through the element 14 through the tape and into the primer setting it off in a reproducible manner.

The primer pocket 12 can be sealed with a water resistant adhesive (not shown) to prevent moisture intrusion and/or to help minimize blowout of the primer when it is fired. First fire mix element 36 boosts the output of the primer. Blow out disk 37 holds the first fire mix in place until use when it then ruptures allowing the burning particles to rapidly and reproducibly ignite the propellant charge 38.

Figure 2:
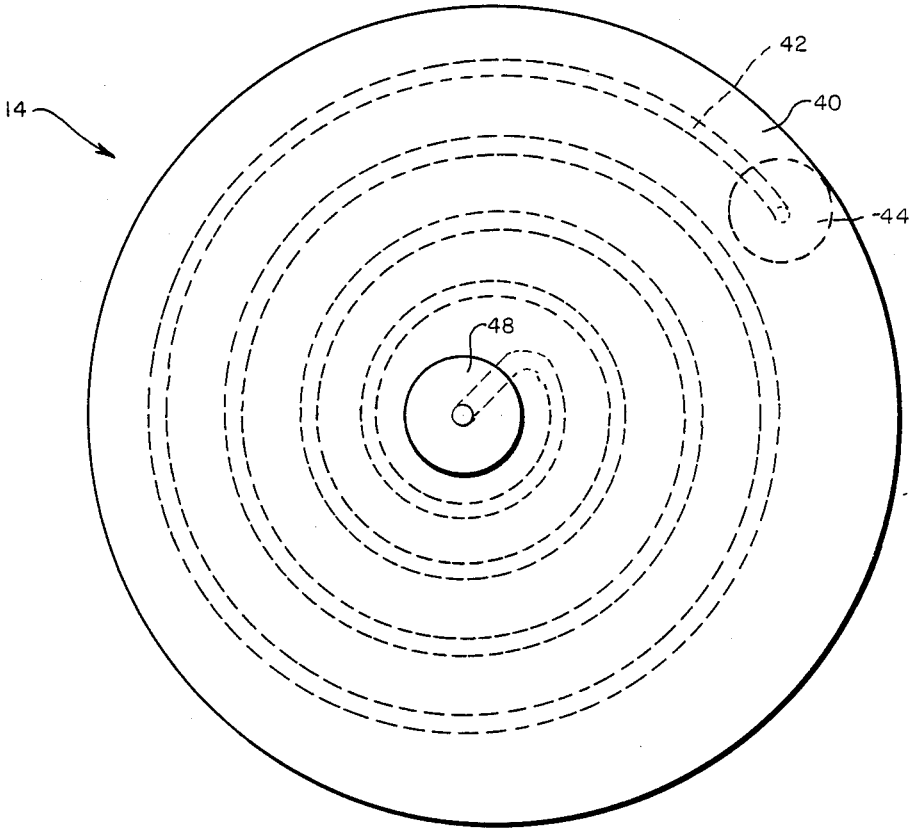
FIG. 2 is a top plan view of one embodiment of the attenuator of the present invention with the conductive path shown in phantom.
Figure 3:
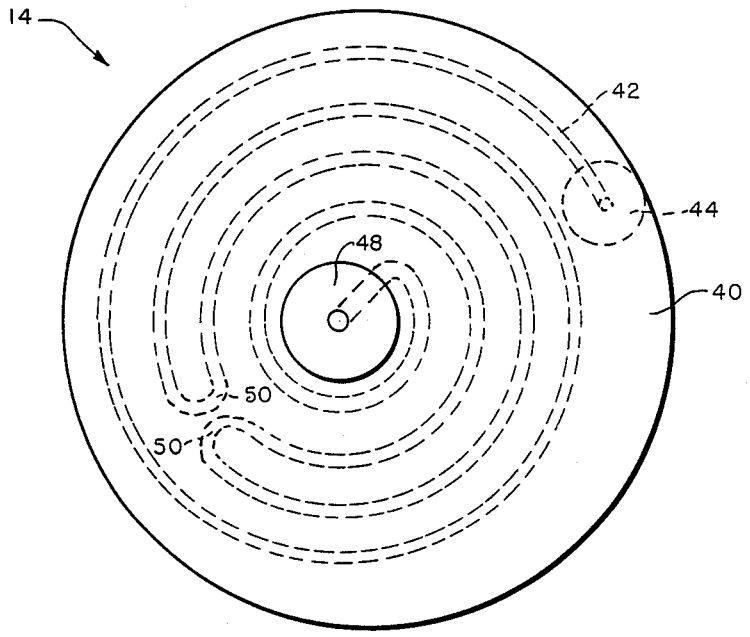
FIG. 3 is a top plan view of another embodiment of the attenuator of the present invention with the conductive path shown in phantom.

The attenuator element 14 is the subject of the present invention and is best shown in FIGS. 2 and 3 to which attention is now directed. The attenuator element 14 includes a body 40 formed of ferrite material such as MN-67. The body 40 is disk shaped with a thickness substantially less than the circular diameter. However other configurations can be used, and the body 40 need not be a flat circular object. Thus, the ratio of dimensions is much smaller than heretofore known initiators such as that shown in U.S. Pat. Nos. 2,821,139, and 2,991,715.

A single firing lead 42 is embedded in the body 40. Firing lead 42 extends from an output button 48 which abuts the primer 16 when the attenuator element is in place in the cass 22.

The firing lead extends from the input button 44 wound in a planar spiral form to the output button 48 whereby current passing through the input button from a source (not shown) via a source lead (not shown) will flow to the output button 48 to ignite the primer.

The spiral winding therefore defines a path in a single plane about a central point coincident with the output button 48. This shape is opposed to a helical path which would be a three-dimensional projection of the spiral winding out of the plane in which it is shown and also is opposed to a tubular coil such as shown in U.S. Pat. No. 2,821,139. The planar spiral winding permits the body to have a large diameter to thickness ratio and achieves a distributed capacitance between adjacent parts of path 42 having an effect superior to the discrete capacitors, and because of the compactness of the device, superior to helical paths or other winding configurations. It is speculated that the larger the number of loops and the closer the spacing between adjacent loops, the higher the attenuation. This however can be traded-off against the temperature rise, unintended stray capacitance, and reliability of the device.

An alternate design is shown in FIG. 3 wherein there is shown a reversal of current direction 50 such that there is a reverse current flowing in an adjacent wire. There can be a plurality of current reversals and data indicates that such a plurality of reversals gives better results. It is not known if there is a point of diminishing returns on the number of reversals.

It is noted that while MN-67 has been disclosed, any suitable RF attenuating ferrite can be used so long as it has a high curie temperature and low frequency attenuation properties. Non-electrically conducting ferrites are preferred to simplify the design. The firing lead can be any conductive material which can be formed into a planar spiral configuration without breaking so that a complete electrical circuit can be maintained after finishing the ferrite manufacturing process. However, lead materials having high after-processing electrical conductivity are preferred with conductive ferrites being more suitable than other materials such as metallic wires. The input and output buttons can be sized to cover as much of the associated body surface as desired. The size and/or shape of the attenuator body can be varied whereby different devices can be identified without the need to color code the firing lead.

Thus there is disclosed an RF attenuator suitable for use with electroexplosive devices. A spiral conductive pattern is embedded within a generally non-conductive disk of ferrite material. The interaction of the magnetic field generated by current with the body of ferrite provides a long distributed inductance in the lead and the distributed stray capacitance between adjacent closely wound leads permits superior attenuation of stray electromagnetic energy inputted to the lead.

Obviously, numerous modifications and variations of the present invention are possible in the light of the above teachings. It is therefore to be understood that within the scope of the appended claims the invention may be practiced otherwise than as specifically described herein.

What is claimed as new and desired to be secured by Letters Patent of the United States is:

1. A fixed or semi-fixed ammunition comprising:

an electrically initiatable primer, and means for connecting said primer to an external initiating source, said means comprising an attenuator for attenuating broad band radio frequency signals present in said means for connecting said primer to an external initiating source, said attenuator comprising a body of electrically nonconductive ferrite material, and a conductive path disposed within the body and having an input and an output terminal, the conductive path being of generally spiral form, disposed generally within a plane and in interactive relationship with the ferrite material, said input and output terminals being connectable to the means for connecting.

2. The ammunition of claim 1 wherein the spiral form of the conductive path has at least one reversal of direction.

3. A fixed or semi-fixed ammunition comprising:

an electrically initiatable primer, and means for connecting said primer to an external initiating source, said means comprising an attenuator for attenuating broad band radio frequency signals present in said means for connecting said primer to an external initiating source, comprising a body of electrically nonconductive ferrite material, and a conductive path disposed within the body and having an input and an output terminal, the conductive path being of generally spiral form having at least one reversal of direction and disposed generally within a plane and in interactive relationship with the ferrite material, said input and output terminals being connectable to the means for connecting.

4. An electroexplosive device comprising:

a metal case; and an electrically initiatable primer; and means for connecting said primer to an external initiating source, said means comprising an attenuator for attenuating broad band radio frequency signals present in said means for connecting said primer to an external initiating source, the attenuator comprising a body of electrically nonconductive ferrite material sized to frictionally engage the inside of said case and transfer heat, whereby said case performs as a heat sink; and a conductive path disposed within said body of ferrite material and having an input and an output terminal, the conductive path being of generally spiral form, disposed generally within a plane and in interactive relationship with the ferrite material, the input and output terminal being connectable to said means for connecting said primer.

5. The electroexplosive device of claim 4 wherein the spiral form of the conductive path has at least one reversal of direction.

* * * * *